US010641299B2

(12) United States Patent
Giesler et al.

(10) Patent No.: US 10,641,299 B2
(45) Date of Patent: May 5, 2020

(54) MONITORING DEVICE FOR TOOL TURRET

(71) Applicant: SAUTER FEINMECHANIK GMBH, Metzingen (DE)

(72) Inventors: Steffen Giesler, Albstadt (DE); Steffen Nixdorf, Gaaden (AT)

(73) Assignee: SAUTER FEINMECHANIK GMBH, Metzingen (DE)

( * ) Notice: Subject to any disclaimer, the term of this patent is extended or adjusted under 35 U.S.C. 154(b) by 46 days.

(21) Appl. No.: 15/778,300

(22) PCT Filed: Nov. 23, 2016

(86) PCT No.: PCT/EP2016/001975
§ 371 (c)(1),
(2) Date: May 23, 2018

(87) PCT Pub. No.: WO2017/092856
PCT Pub. Date: Jun. 8, 2017

(65) Prior Publication Data

US 2018/0347600 A1 Dec. 6, 2018

(30) Foreign Application Priority Data

Dec. 3, 2015 (DE) ..... 10 2015 015 858

(51) Int. Cl.
*F15B 11/072* (2006.01)
*F15B 15/28* (2006.01)

(52) U.S. Cl.
CPC ..... *F15B 15/2807* (2013.01); *F15B 11/072* (2013.01); *F15B 15/2838* (2013.01);
(Continued)

(58) Field of Classification Search
CPC ..... F15B 15/2807; F15B 11/062
(Continued)

(56) References Cited

U.S. PATENT DOCUMENTS 3,691,902 A 9/1972 Lebzelter
5,187,847 A 2/1993 Thumm et al.
(Continued)

FOREIGN PATENT DOCUMENTS

DE 1 576 070 6/1969
DE 41 16 774 5/1992
(Continued)

OTHER PUBLICATIONS

International Search Report (ISR) dated Feb. 23, 2017 in International (PCT) Application No. PCT/EP2016/001975.

*Primary Examiner* — Michael Leslie
*Assistant Examiner* — Daniel S Collins
(74) *Attorney, Agent, or Firm* — Wenderoth, Lind & Ponack, L.L.P.

(57) ABSTRACT

A monitoring device for determining a position of a displacement piston (1) guided longitudinally movably in a housing (7) and, in the housing (7) and delimits a fluid chamber (3, 5) with a variable volume and connected via a pressure supply connector (9, 11) to a pressure fluid control device (13). A volumetric flow regulating device (45) and a pressure determining device (47) are connected between the pressure fluid control device (13) and the measuring connector (15, 17) of the fluid chamber (5, 3). The pressure determining device (47) outputs a measuring signal when the displacement piston (1) reaches an end position.

20 Claims, 6 Drawing Sheets

(52) U.S. Cl.
CPC ..... *F15B 2211/40569* (2013.01); *F15B 2211/41536* (2013.01); *F15B 2211/6313* (2013.01)

(58) Field of Classification Search
USPC ..... 60/446
See application file for complete search history.

(56) References Cited

U.S. PATENT DOCUMENTS

| | | | |
|---|---|---|---|
| 5,778,753 | A | 7/1998 | Higgins |
| 2007/0006580 | A1 | 1/2007 | Hesse |

FOREIGN PATENT DOCUMENTS

| | | |
|---|---|---|
| DE | 601 12 685 | 6/2006 |
| DE | 10 2009 042 772 | 7/2011 |
| DE | 10 2012 019 863 | 10/2013 |
| WO | 2005/024245 | 3/2005 |

MONITORING DEVICE FOR TOOL TURRET

FIELD OF THE INVENTION

The invention relates to a monitoring device for determining at least one position of a displacement piston, which is guided longitudinally movably in a housing. In the housing, the displacement piston delimits at least one fluid chamber with a variable volume. The fluid chamber is connected via a pressure supply connector to a pressure fluid control device.

BACKGROUND OF THE INVENTION

The prior art uses displacement pistons in tool turrets, which displacement pistons are movable by pressure activation and which can be actuated by a pressure fluid control device, in order to realize switching operations. These operations may involve the locking of the rotational movement of the turret head relative to the housing or the activation of a slide coupling between a motorized drive device and a machining tool to be driven. Document DE 41 16 774 C1 for example presents a tool turret in which, in order to lock the rotational movement of the turret head relative to the housing, coaxial Hirth teeth are provided on the housing and on the turret head, with which, for the purpose of locking, teeth on a displacement piston engage. The displacement piston is pressure activated. Document DE 10 2009 042 772 A1 discloses a drive device in a tool turret in which, to switch a slide coupling, the drive shaft of the coupling forms a displacement piston, which is hydraulically movable for the switching operations of the coupling.

For the operating control of the corresponding tool turret, control of the switching operations realized by the sliding piston is essential. This control usually involves an inductive proximity switch detecting the piston position in an end position. Because suitable proximity switches require a lot of installation space and because they are also costly, detection of only one end position of the piston has been possible until now.

SUMMARY OF THE INVENTION

Given these issues, the problem addressed by this invention is to provide an improved monitoring device with a compact construction that permits easy monitoring of at least one piston end position.

According to the invention, this problem is basically solved by a monitoring device having, as a significant feature of the invention, a volume flow control device and, following the valve control device in the direction of the measuring connector, a pressure determining device are connected between the pressure fluid control device and a measuring connector of the assignable fluid chamber of the displacement piston. The pressure determining device outputs a measuring signal at least when the displacement piston has reached a predefinable end position in the housing. The fluid detection, in which the pressure fluid control device is a component of the monitoring device, is without proximity switches, simplifies the construction work and reduces the space requirement. Furthermore, in the case of the preferably provided measuring connectors on the chambers, located on the two sides of the piston, with an associated pressure determining device, both opposite end positions of the piston are detectable.

The solution according to the invention is preferably applied in tool turrets or tool disks, of the kind usually employed in machine tools for machining processes. Other applications include milling spindles, rotary tables and so forth, and wherever a monitoring of fluid-controllable adjusting cylinders is required, in particular with respect to the end location position thereof.

The volume flow control device can be formed from at least an aperture with a pressure-reducing valve connected downstream in the direction of the measuring connector. The pressure determining device can be a pressure switch, which outputs a measuring signal once the displacement piston closes the measuring connector in the assignable fluid chamber. In this arrangement, the volume flow control device is preferably designed for a very small volume flow, which is supplied from the pressure fluid control device to the respective measuring connector, which is closed in a corresponding end location of the piston, which leads to a pressure rise in the corresponding measuring line which leads to the measuring connector, by which the corresponding pressure switch is switched.

Between the pressure determining device and the assignable measuring connector a spring-loaded check valve can be advantageously connected. This valve opens in the direction of the measuring connector and has only little closing pressure, preferably smaller than 1 bar, preferably 0.5 bar. The measuring line is then secured against the activation pressure that prevails in the fluid chamber and that moves the piston away from the measuring connector.

The arrangement can advantageously be such that the fluid chamber is connected to the measuring connector at a pressure supply connector of the pressure fluid control device. By this connection, the pressure fluid outflows at a pressure sink or tank, once the displacement piston moves in the direction of the measuring connector.

In particularly advantageous exemplary embodiments, the displacement piston delimits in the housing two fluid chambers. Each fluid chamber adjoins a piston side and are both connected to a pressure determining device. For its displacement movements in both directions, the displacement piston can then be hydraulically activated by pressure supply connectors of the pressure fluid control device.

Alternatively, the one fluid chamber can be hydraulically actuatable, and the other fluid chamber of the displacement piston can be pneumatically actuatable, preferably supported by an energy store such as a compression spring.

In both of the above-mentioned cases, the respective pressure fluid control device can have at least one control valve between at least one pressure supply source and the respective hydraulically loadable fluid chamber of the displacement piston.

Depending on whether the embodiment is a purely hydraulic or a hydraulic/pneumatic action embodiment, pressure supply sources are provided. The sources supply a pneumatic medium and/or hydraulic medium into the supply circuit for the displacement piston.

The displacement piston, the positions of which can be determined by the monitoring device, can be a component of a Hirth tooth system of the locking device between the tool turret and the housing or it can be a component of a tool coupling, by which a motorized tool drive can be coupled with a machining tool on a tool turret.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
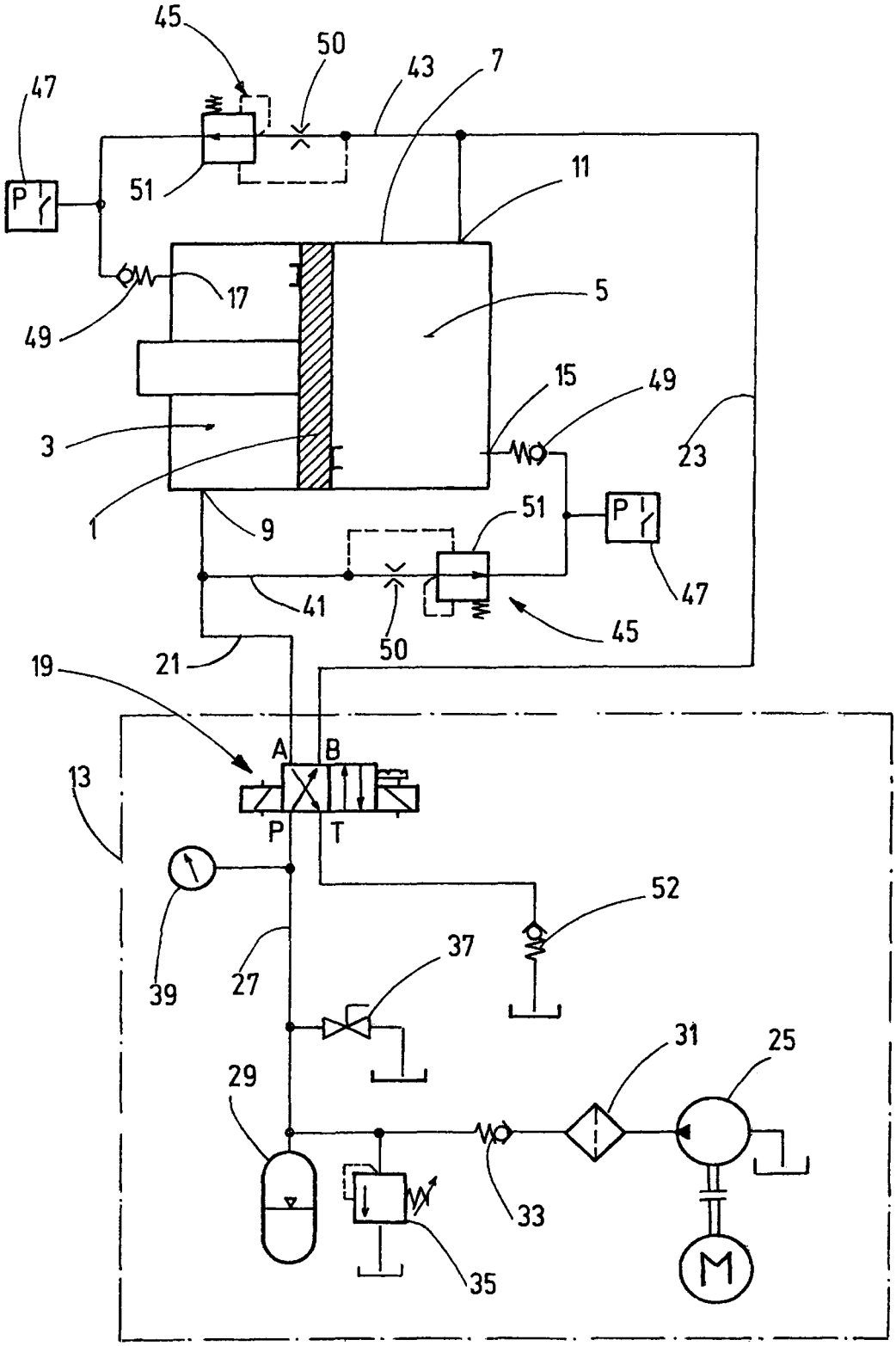
FIG. 1 is in a symbolic flow diagram of a hydraulic circuit of a first exemplary embodiment of the monitoring device according to the invention.

FIG. 1 shows the fluid circuit for a first exemplary embodiment of the monitoring device according to the invention. A corresponding displacement piston 1 with its two piston sides delimiting first and second fluid chambers 5 and 3, which are closed but for the inlets and outlets in the housing 7 of a tool turret. By supplying hydraulic pressure fluid into the second fluid chamber 3, the piston 1 can be displaced from the depicted intermediate position towards the right into an end position, which, when the piston 1 forms a component of a locking device, corresponds to the locked state between the turret head and the housing. By a build-up of hydraulic pressure in the first fluid chamber 5, the piston 1 can be displaced towards the left into an end position, which in this case corresponds to the unlocked state of the turret head and housing. For the supply with pressure fluid, a second supply connector 9 is provided at the fluid chamber 3, and a first supply connector 11 is provided at the fluid chamber 5, which connectors are each connected to a pressure fluid control device 13. In addition, a second measuring connector 17 is provided at the fluid chamber 3 and a first measuring connector 15 is provided at the fluid chamber 5. These measuring connectors 15, 17 can each be closed by the piston 1, preferably in a tight manner, when said piston reaches the respective corresponding end position. The piston 1 closes the measuring connector 15 when the locked position is reached and closes the measuring connector 17 when the unlocked position is reached.

The pressure fluid control device or control 13 has an electrically activated 4/2-way valve 19 with service connectors A and B, a pressure connector P and a tank connector T as a pressure sink. The service connector A is connected via a supply line 21 to the supply connector 9 of the fluid chamber 3. The service connector B is connected via a supply line 23 to the supply connector 11 at the fluid chamber 5. A pressure supply unit is connected to the pressure connector P of the directional valve 19, which pressure supply unit has, as is conventional for such supply units, an electromotively driven hydraulic pump 25, which provides the working pressure for a pressure line 27 leading to the pressure connector P of the directional valve 19. For the purpose of pressure stabilization, a hydropneumatic pressure accumulator 29 is connected with its fluid side thereto. The gas side of accumulator 29 is preloaded corresponding to the working pressure provided for the pressure line 27 with 40 bar, for example. In the line section extending from the hydraulic pump 25 to the pressure line 27, a filter 31 is connected to the pressure side of the hydraulic pump 25. A check valve 33 opens in the direction of the pressure line 27. A pressure control valve 35 secures the pressure line 27 against the tank and is set to a pressure of 50 bar, for example. Also located in the pressure line 27 are a manually activatable cut-off valve 37 permitting the emptying of the system and a manometer 39.

In the case of the first exemplary embodiment depicted in FIG. 1, in which a purely hydraulic activation is provided for the displacement piston 1, both fluid chambers 3 and 5 as pressure chambers are connected via their supply connectors 9 and 11 and the associated supply lines 21 and 23 to the service connectors A and B of the directional valve 19. In addition, both measuring connectors 15 and 17 are connected via a respective measuring line to the pressure fluid control device 13 in such a way that the measuring connector 15 is connected via a measuring line 41 to the service connector A, and the measuring connector 17 is connected via a measuring line 43 to the service connector B of the directional valve 19. A volume flow control device 45, a pressure switch 47 and a check valve 49 are arranged in each of the measuring lines 41 and 43 in a consecutive manner in the direction of the respective measuring connector 15 and 17.

The volume flow control devices 45 are formed in each case by an aperture 50 and a pressure-reducing valve connected downstream relative thereto in the direction of the respective measuring connector 15 and 17. The check valve 49 is connected as part of the measuring lines 41 and 43 directly to the respective measuring connector 15 and 17, opens in the direction of the measuring connector 15, 17, and is set to a low closing pressure of 0.5 bar, for example. The volume flow control devices 45 are designed such that in the measuring lines 41 and 43, in the case of an opened check valve 49, only a very low volume flow flows to the associated measuring connector 15, 17. In this process, no significant pressure builds up at the measuring connectors 15, 17 because, in the case of a displacement of the piston 1, fluid from the respective chamber 3, 5 can flow off directly via the lines 9 and 11.

In this arrangement the functioning of the position monitoring is as follows. FIG. 1 shows a state, in which the directional valve 19 connects the pressure connector P to the service connector B, so that the working pressure supplies the fluid chamber 5 with working pressure via the supply line 23 and the supply connector 11. In the case of a closed check valve 49, the displacement piston 1 thus moves in the direction of the unlocked position (to the left in FIG. 1), with the fluid volume located in the fluid chamber 3 being pushed from the supply connector 9 via the supply line 21 to the service connector A of the directional valve 19 and flowing off from there via the tank connector T. Tank connector T serves as a pressure sink and is connected to the tank via a check valve 52. Because check valve 52 is set to a very low opening pressure and the fluid chamber 3 is then essentially unpressurized, the check valve 49 connected to the measuring connector 17 is open. Once the piston 1 reaches its locked end position however, check valve 49 closes the measuring connector 17, which leads to a pressure increase in the measuring line 43. By that pressure increase in measuring line 43, the pressure switch 47 is switched and a position signal for the locked end position is delivered.

In a corresponding manner, the detection of the locked end position occurs with switching of the directional valve 19 from the switching state depicted in FIG. 1, with the displacement movement of the piston 1 taking place towards the right in FIG. 1 closing the measuring connector 15 and the pressure rise in the measuring line 41 producing the switch operation of the pressure switch 47, so that the locked end position is signaled.

Figure 2:
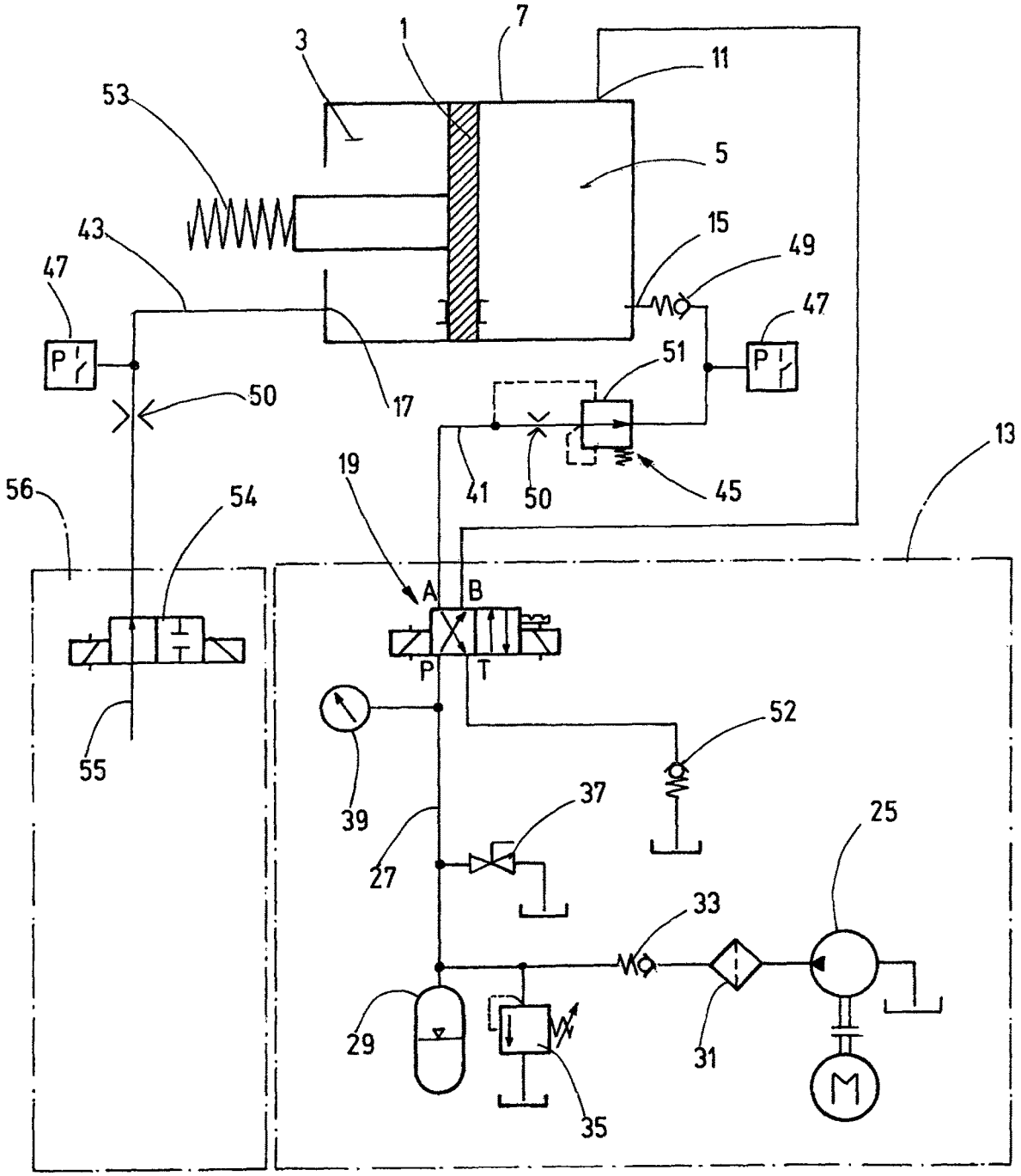
FIG. 2 is in a symbolic flow diagram of a hydraulic/pneumatic circuit of a second exemplary embodiment of the monitoring device according to the invention.

In the case of the exemplary embodiment depicted in FIG. 2, only the fluid chamber 5 is provided as a pressure chamber for pressure activation of the piston 1. The piston movement in FIG. 2 is towards the right in the direction of the end position. In this embodiment, that end position is provided as a coupling end position of a slide coupling, cf. FIG. 9, and is produced by a compression spring 53. The housing 7 guiding the displacement piston 1 is open at the piston side where the compression spring 53 contacts the piston 1, but has, as in the case of the first embodiment, a measuring connector 17, which can be closed in the uncoupled end position of the displacement piston 1. The pressure fluid control device 13 is formed, like in the first embodiment. The measuring line 41, which extends from the service connector A of the directional valve 19 to the measuring connector 15 on the fluid chamber 5. The supply connector 11 of fluid chamber 5 is, like in the first embodiment, connected via the supply line 23 to the service connector B of the directional valve 19.

The difference compared with the first embodiment is that, for a pneumatic detection of the uncoupled end position, in which the piston 1 closes the measuring connector 17, a pneumatic supply 56 is provided. Pneumatic supply 56 is connected to the measuring line 43 leading to the measuring connector 17. This pneumatic supply has an electrically activatable 2/2-way valve 54, by which the measuring line 43 can be connected to an output line 55 of a not depicted source for a pneumatic pressure in the range from 2 to 6 bar. The measuring line 43 has, like in the first embodiment, an aperture 50 and a pressure switch 47 connected downstream of aperture 50 in the direction of the measuring connector 17. The other measuring line 41 associated with the fluid chamber 5 is formed as in the first embodiment. The detection of the coupled end position then occurs in the manner of the first embodiment, while the uncoupled end position provides, by the increase in the pneumatic pressure in the measuring line 43 produced by closure of the measuring connector 17, the position signal by switching of the pressure switch 47.

Figure 3:
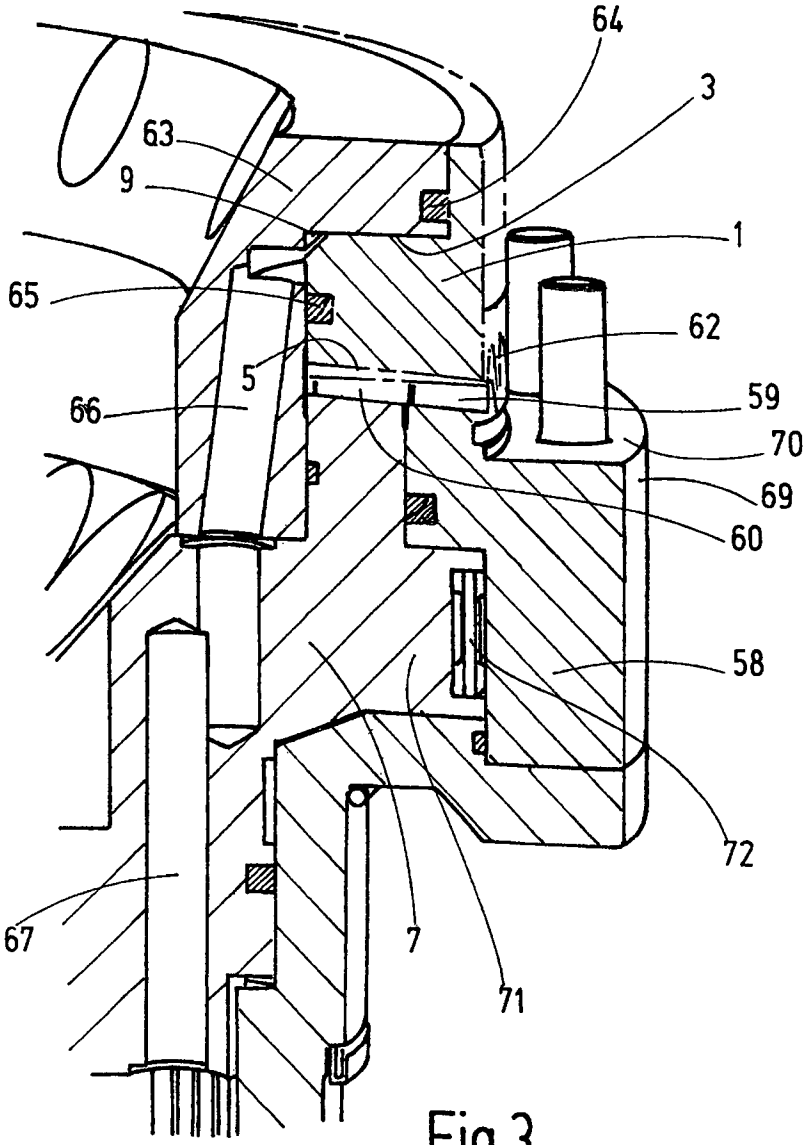
FIG. 3 is a simplified and schematic partial perspective view in section in which only the portion of a tool turret is depicted that is adjacent to a locking device between the housing and the turret head and that is provided with a monitoring device according to the first exemplary embodiment of the invention.
Figure 4:
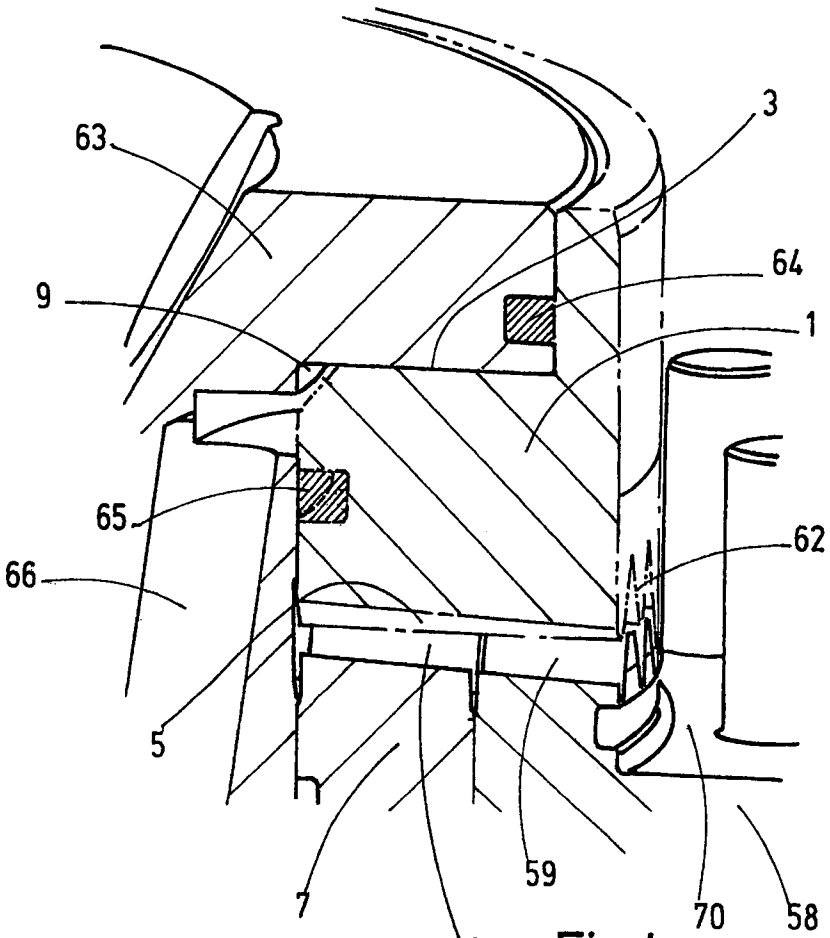
FIG. 4 is an enlarged perspective view in section of partial segment of FIG. 3.
Figure 5:
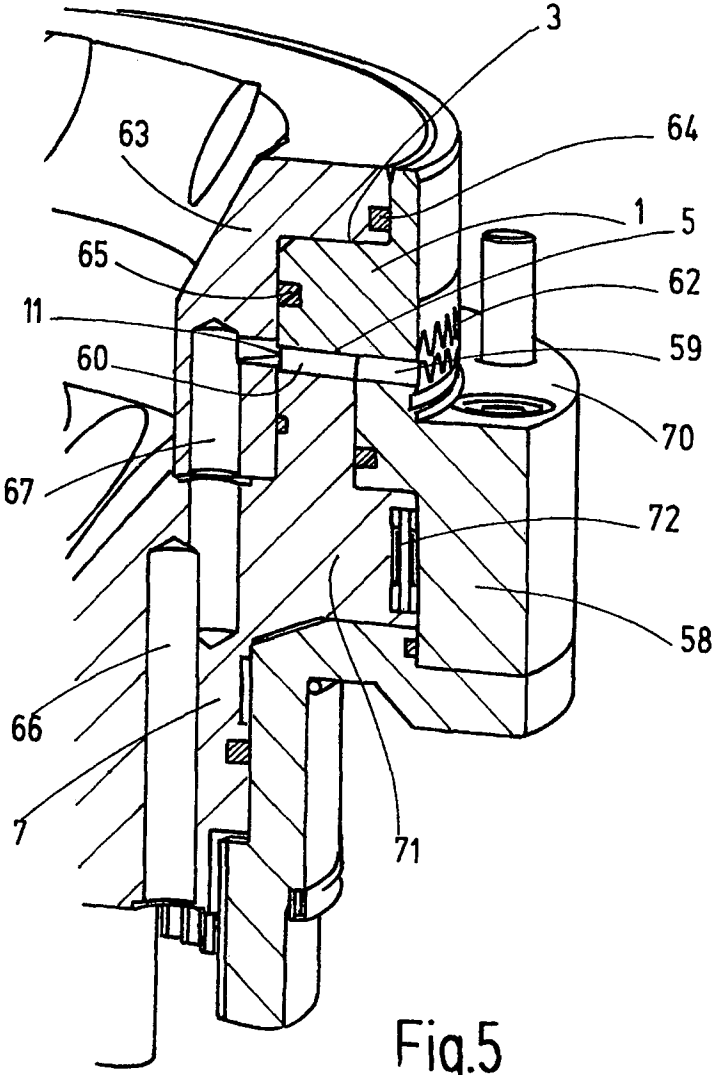
FIG. 5 is a partial perspective views in section, corresponding to FIG. 3, with a rotated cutting plane relative to FIG. 3.
Figure 6:
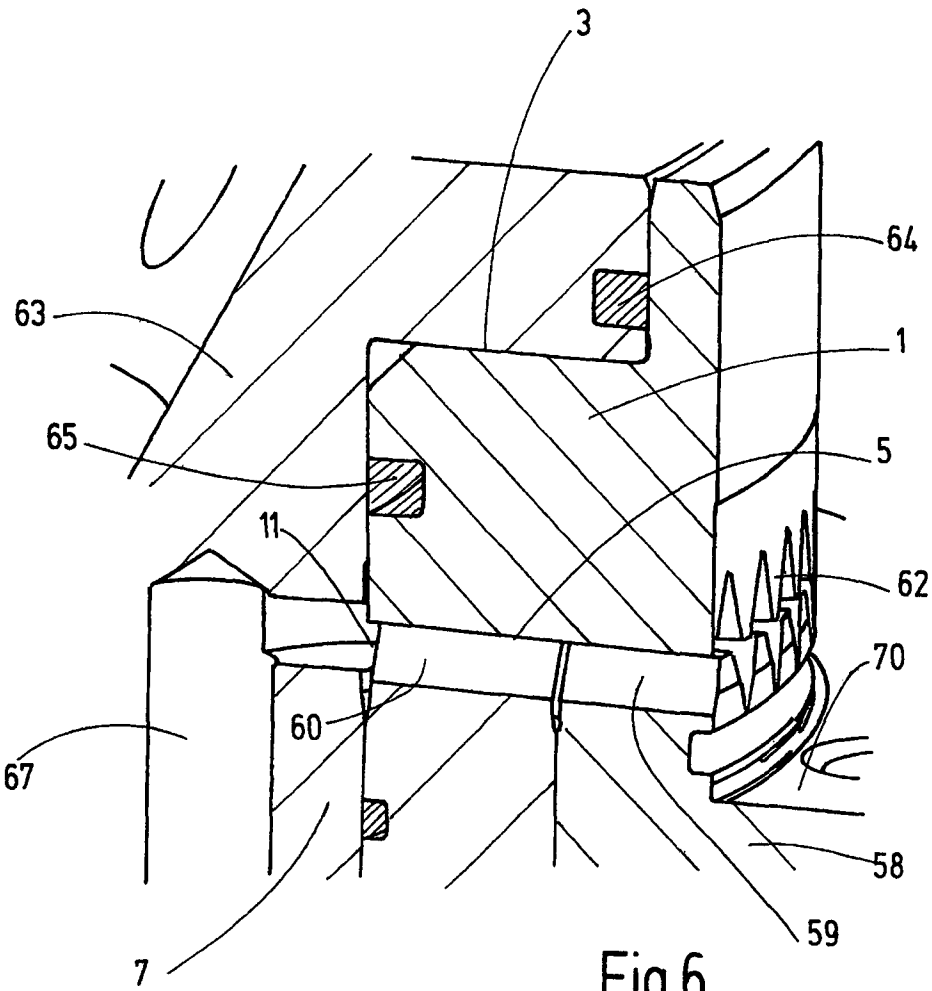
FIG. 6 is an enlarged perspective view in section of a partial segment of FIG. 5.

FIGS. 3 to 8 illustrate the use of the first embodiment of the monitoring device according to the invention for detection of the switching states of the locking device by which the turret head 58 of a tool turret can be locked in selected rotation positions relative to the housing 7. The locking device of the tool turret has, in a known manner on the turret head 58 and concentric to the rotational axis of the turret head 58, a toothed ring 59 in the form of radial teeth, a Hirth tooth system. Concentric to the toothed ring 59 and aligned therewith, a second toothed ring 60, likewise having a Hirth tooth system, is formed on the housing 7. For the locking engagement with these toothed rings 59, 60, the displacement piston 1 is provided as a locking part, which likewise has a toothed ring 62 in the form of a Hirth tooth system which, in the locked position, engages with the toothed rings 59, 60. In FIGS. 3 to 7, the displacement piston 1 is respectively depicted in its unlocked end position lifted off the toothed rings 59, 60. For its displacement movements the piston 1 is guided in an annular body 63 of the housing 7 and is sealed relative thereto by sealing rings 64 and 65 so that, on both axially opposite sides of the piston 1, the fluid chambers 3 and 5 allowing the pressure activation are formed. FIGS. 3 and 4 show a channel 66 extending in the housing 7, which channel 66 forms the supply line 21 for the fluid supply to the supply connector 9 of the fluid chamber 3. FIGS. 5 and 6 show a channel 67 in the housing 7, which forms the supply line 23 for the fluid supply to the supply connector 11 of the fluid chamber 5.

FIGS. 3 to 8, in which the tool turret is only partially depicted, do not show the tool disk, which is provided with a tool receptacle in a conventional manner. For receiving this tool disk, the turret head 58 has a radially projecting ring flange 69, which forms a contact surface 70, on which the not depicted tool disk is mounted. The rotational bearing for the turret head 58 has a radial bearing 72 on a guide part 71 radially projecting from the housing 7, which is overlapped by the turret head 58.

Figure 7:
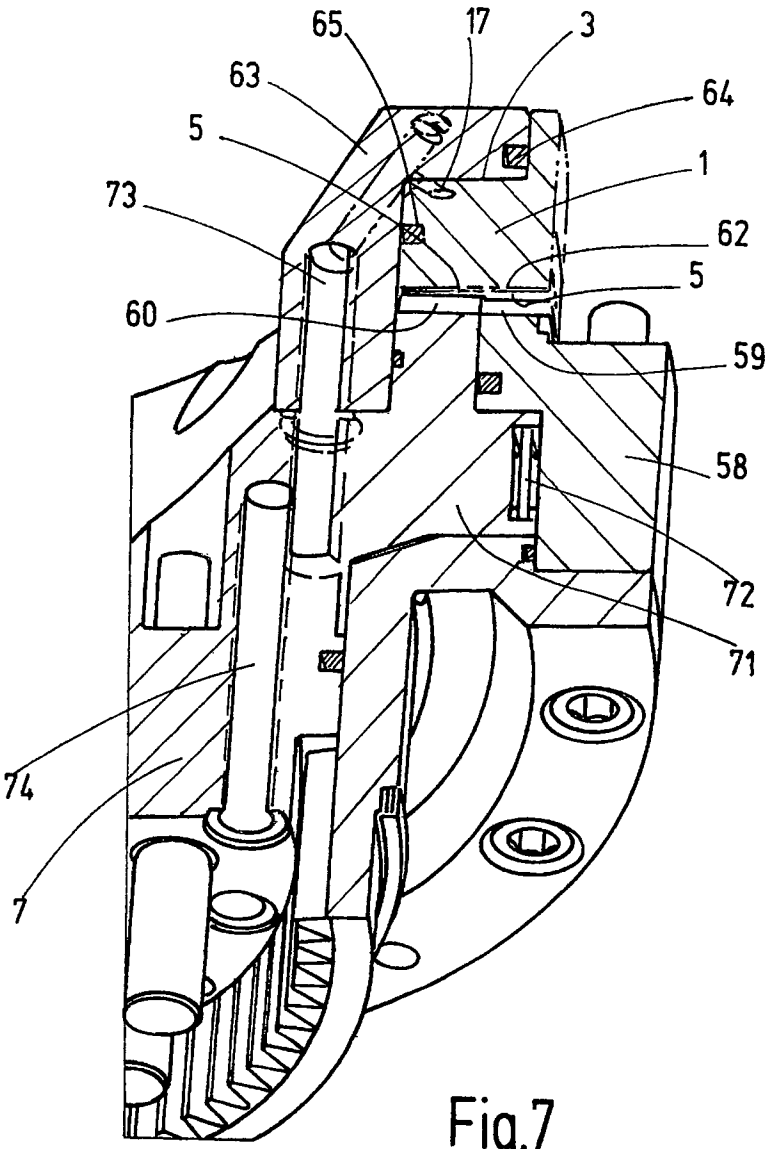
FIGS. 7 and 8 are partial perspective views in section of the area of the turret head adjacent to the locking device with a rotated cutting plane relative to FIGS. 3 and 5.
Figure 8:
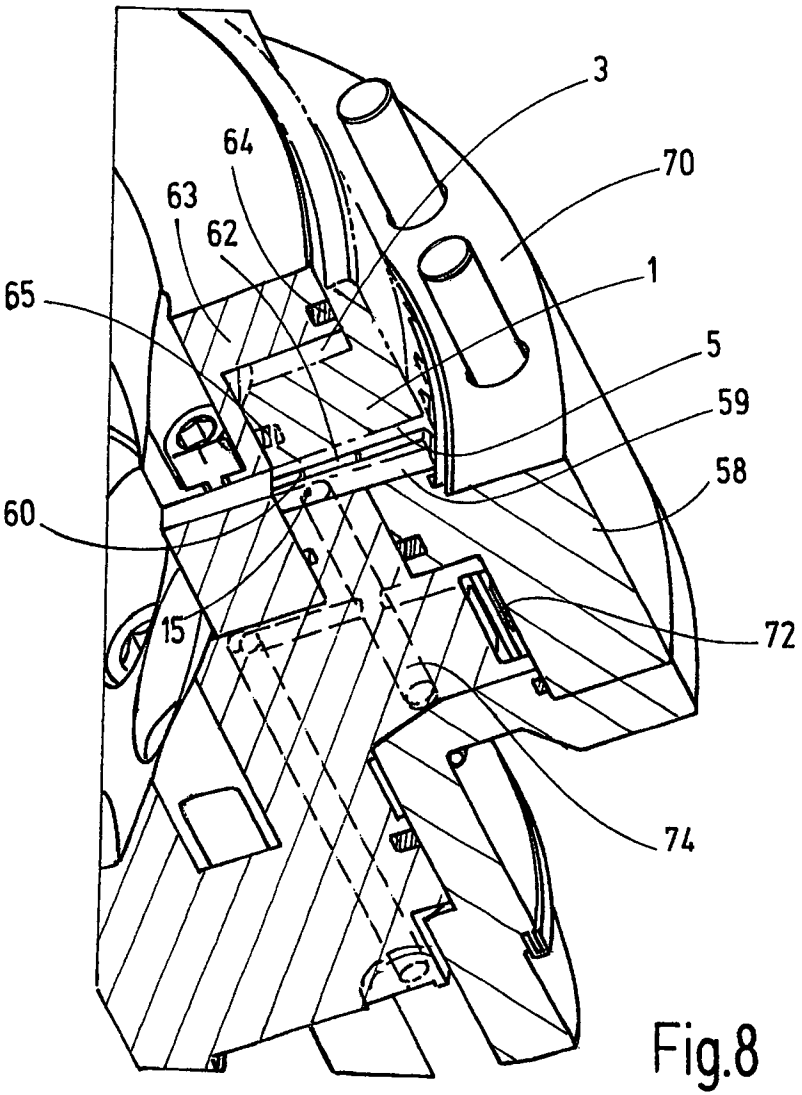

The external pressure fluid control device 13, to which the channels 66 and 67 forming the supply lines 21 and 23 lead, is not depicted in the partial depictions of FIGS. 3 to 8. Also not depicted are the volume flow control devices 45 which, together with the associated pressure switch 47 and check valve 49, are connected to the measuring connectors 15 and 17 of the fluid chambers 5 and 3. These measuring connectors 15 and 17 are depicted in FIGS. 7 and 8. Of these, FIG. 7 shows the measuring connector 17 located at the fluid chamber 3 that, in the unlocked end position of the piston 1 depicted in this figure, is closed. In this figure a measuring channel 73 extends from the measuring connector 17 to the check valve 49 of the assigned measuring line 43. FIG. 8, which depicts the piston 1 in the locked end position, shows a measuring channel 74 extending from the measuring connector 15 of the fluid chamber 5 to the check valve 49 of the assigned measuring line 41. The pressure-activated displacement of the piston 1 into either end position, in which the measuring connector 9 or 11 is closed, then generates the pressure signal, which switches the respective associated pressure switch 47 to signal the respective end position.

Figure 9:
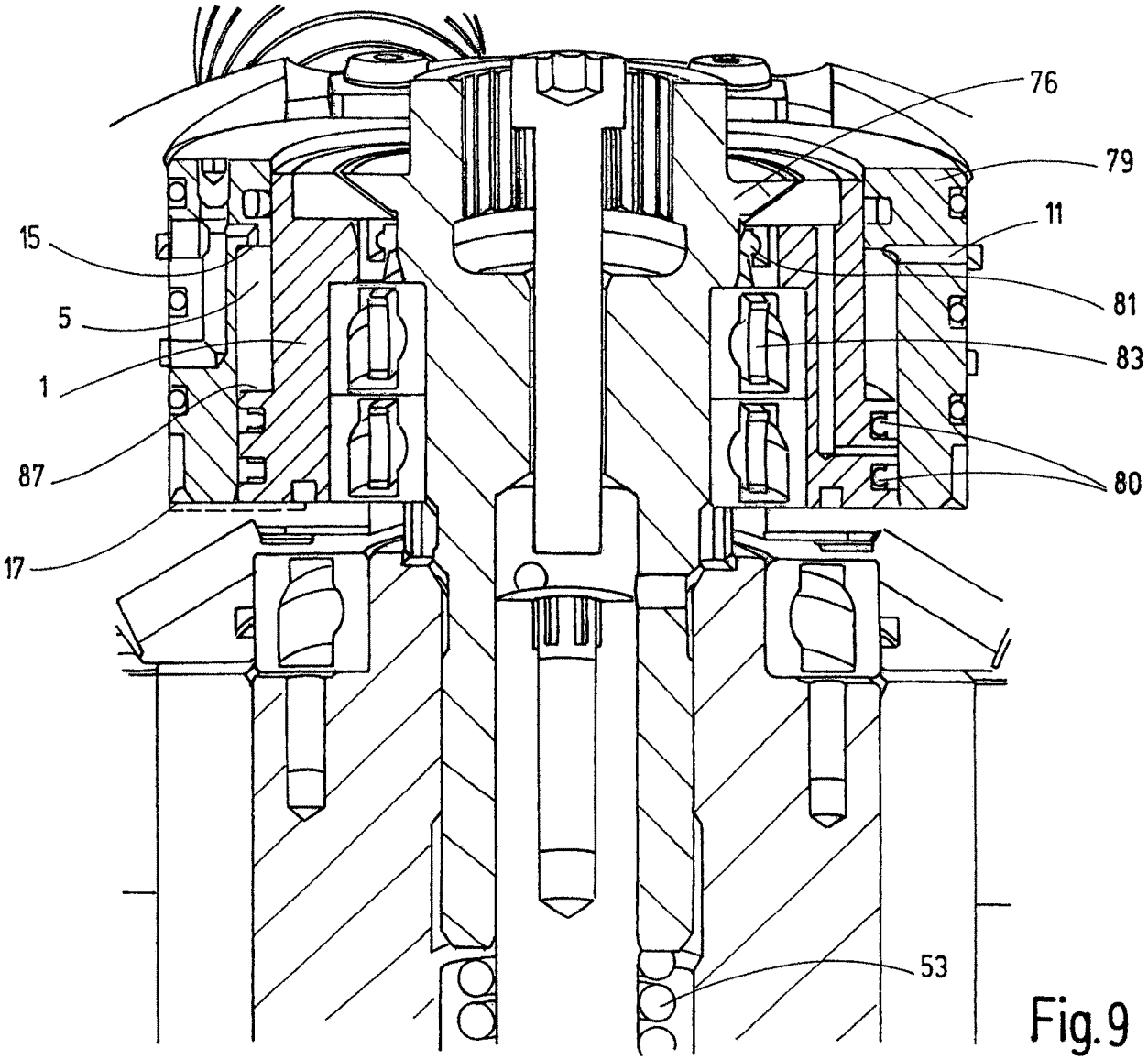
FIG. 9 is a schematically simplified and perspective view in section of a tool turret having the motorized drive device for a tool drive with a slide coupling activatable by a displacement piston, which displacement piston is provided with a monitoring device according to the second exemplary embodiment of the invention.

FIG. 9 illustrates the use of the second exemplary embodiment (FIG. 2) of the monitoring device according to the invention for detection of the coupled state and the uncoupled state of a slide coupling, by which in a tool turret an electromotive drive can be coupled with a machining tool. The displacement coupling has an axially displaceable coupling hub 76, which is depicted in FIG. 9 in its uncoupled position pushed back against the force of the compression spring 53 contacting it. This displacement force is produced by pressure activation of the displacement piston 1, which is guided in an annular body 79 forming a cylinder sleeve. The piston 1 is sealed relative to the annular body 79 and the coupling hub 76 by seals 80 and 81, so that at the piston outer side the fluid chamber 5 forms a pressure chamber that, by the pressure supply via the supply connector 11, moves the piston 1 in FIG. 9 downwards and displaces the coupling hub 76 together with its roller bearing 83 overlapped by the piston 1 downwards into the uncoupled position.

For the detection of this uncoupled position, the piston 1 closes the measuring connector 17 located on its bottom side. When switching to the coupled state by interruption of the pressure supply of the fluid chamber 5 via the supply connector 11 thereof, the compression spring 53 displaces the coupling hub 76 with the piston 1 in FIG. 9 upwards, so that the piston 1 closes the measuring connector 15 with a step 87 delimiting the fluid chamber 5, and then generates the pressure signal, by means of which the pressure switch 47 closes and the coupled state is signaled.

While various embodiment have been chosen to illustrate the invention, it will be understood by those skilled in the art that various changes and modifications can be made therein without departing from the scope of the invention as defined in the claims.

The invention claimed is:

1. A monitoring device, comprising:

a housing having first and second fluid chambers and having first and second measuring connectors in fluid communication coupled respectively to said first and second fluid chambers having variable volumes;

a displacement piston guided for longitudinal movement in said housing and separating said first and second fluid chambers;

a volume fluid pressure control connected to said first fluid chamber via a first pressure supply connector, said volume fluid pressure control including an aperture and a pressure-reducing valve connected downstream in a direction of said first measuring connector; and a first pressure determinator being connected between said volume fluid pressure control said first measuring connector, said first pressure determinator emitting a first measuring signal when said displacement piston reaches a first end position in said housing.

2. A monitoring device according to claim 1 wherein said first pressure determinator comprises a pressure switch emitting the measuring signal upon said displacement piston closing said first measuring connector.

3. A monitoring device according to claim 1 wherein a spring-loaded check valve is connected between said first pressure determinator and said first measuring connector, opens in the direction of said first measuring connector and has a low closing pressure.

4. A monitoring device according to claim 3 wherein said low closing pressure is less than one bar.

5. A monitoring device according to claim 3 wherein said low closing pressure is 0.5 bar.

6. A monitoring device according to claim 1 wherein said first fluid chamber is connected to said first measuring connector at said first pressure supply connector of said volume fluid pressure control, pressure in said first fluid chamber flowing away from said first fluid chamber to a pressure sink when said displacement piston moves in a direction toward said first measuring connector.

7. A monitoring device according to claim 1 wherein said second fluid chamber is connected to a second pressure determinator, between said volume fluid pressure control and said second measuring connector, said second measuring connector emitting a second measuring signal when said displacement piston reaches a second end position in said housing.

8. A monitoring device according to claim 1 wherein said first fluid chamber is hydraulically operated to move said displacement piston; and said second fluid chamber is pneumatically operated to move said displacement piston.

9. A monitoring device according to claim 8 wherein said displacement piston is biased by a compression spring in a direction of said first measuring connector.

10. A monitoring device according to claim 1 wherein said volume fluid pressure control comprises a control valve between a hydraulic pressure supply source and said first fluid chamber.

11. A monitoring device according to claim 1 wherein said first and second fluid chambers are connectable in fluid communication with first and second pressure sources, respectively, supplying at least one of a hydraulic pressure medium or a pneumatic pressure medium on said displacement piston via a supply circuit.

12. A monitoring device according to claim 1 wherein said displacement piston is connected to at least one of a Hirth tooth system or a tool coupling of a tool turret.

13. A monitoring device according to claim 7 wherein said second pressure determinator comprises a pressure switch emitting the measuring signal upon said displacement piston closing said second measuring connector.

14. A monitoring device according to claim 7 wherein a spring-loaded check valve is connected between said second pressure determinator and said second measuring connector, opens in the direction of said second measuring connector and has a low closing pressure.

15. A monitoring device according to claim 14 wherein said low closing pressure is less than one bar.

16. A monitoring device according to claim 7 wherein said second fluid chamber is connected to said second measuring connector at said second pressure supply connector of said volume fluid pressure control, pressure in said second fluid chamber flowing away from said second fluid chamber to a pressure sink when said displacement piston moves in a direction toward said second measuring connector.

17. A monitoring device according to claim 7 wherein said first fluid chamber is hydraulically operated to move said displacement piston; and said second fluid chamber is pneumatically operated to move said displacement piston.

18. A monitoring device according to claim 17 wherein said displacement piston is biased by a compression spring in a direction of said first measuring connector.

19. A monitoring device according to claim 7 wherein said volume fluid pressure control comprises a control valve between a hydraulic pressure supply source and said second fluid chamber.

20. A monitoring device according to claim 7 wherein said first and second fluid chambers are connectable in fluid communication with first and second pressure sources, respectively, supplying at least one of a hydraulic pressure medium or a pneumatic pressure medium on said displacement piston via a supply circuit.

* * * * *